US007381001B2

(12) United States Patent
Maruyama et al.

(10) Patent No.: US 7,381,001 B2
(45) Date of Patent: Jun. 3, 2008

(54) THERMAL TRANSFER PRINTER

(75) Inventors: Takahito Maruyama, Fukushima-ken (JP); Yoshibumi Abe, Fukushima-ken (JP)

(73) Assignee: Alps Electric Co., Ltd, Tokyo (JP)

( * ) Notice: Subject to any disclaimer, the term of this patent is extended or adjusted under 35 U.S.C. 154(b) by 0 days.

(21) Appl. No.: 11/271,260

(22) Filed: Nov. 8, 2005

(65) Prior Publication Data

US 2006/0104695 A1 May 18, 2006

(30) Foreign Application Priority Data

Nov. 17, 2004 (JP) ..... 2004-333326

(51) Int. Cl.
*B41J 2/325* (2006.01)
*B41J 2/315* (2006.01)
*B41J 2/32* (2006.01)

(52) U.S. Cl. ..... 400/120.01; 400/120.16

(58) Field of Classification Search ..... 400/208, 400/120.01, 120.16; *B41J 2/325, 17/30, B41J 31/00*

See application file for complete search history.

(56) References Cited

U.S. PATENT DOCUMENTS 4,739,341 A * 4/1988 Matsuno et al. ..... 400/248
4,962,387 A * 10/1990 Yamamoto et al. ..... 400/248
5,110,229 A * 5/1992 Ide ..... 400/249
5,144,335 A * 9/1992 Maslanka et al. ..... 400/248
5,266,967 A 11/1993 Maslanka et al.
5,434,597 A 7/1995 Muranaka et al.
5,516,219 A * 5/1996 Leonard et al. ..... 400/246
5,547,183 A * 8/1996 Tamura ..... 271/264
5,609,425 A * 3/1997 Kawano et al. ..... 400/120.01
5,903,299 A * 5/1999 Kawano ..... 347/217
5,921,687 A * 7/1999 Koike et al. ..... 400/120.01
5,936,653 A 8/1999 Yamaguchi et al.

(Continued)

FOREIGN PATENT DOCUMENTS

GB 2 289 444 A 11/1995

(Continued)

OTHER PUBLICATIONS

Chinese First Notice of Examiner's Opinion for Application No. 2005101253732 including an English translation.

(Continued)

*Primary Examiner*—Edward Lefkowitz
*Assistant Examiner*—Jonathan Dunlap
(74) *Attorney, Agent, or Firm*—Brinks Hofer Gilson & Lione

(57) ABSTRACT

A thermal transfer printer includes a thermal head, a platen roller which allows the thermal head to be in the head up/down state, an ink ribbon which is drawn between the thermal head and the platen roller, a paper feed roller which can convey a recording paper. A peeling member is disposed on the downstream side of the thermal head in a conveyance direction of the recording paper and can peel the ink ribbon adhered onto the recording paper during printing, and an optical ribbon detecting sensor, which can detect a color discernment marker corresponding to an ink surface of a desired color formed on the surface of the ink ribbon, is disposed between the thermal head and the peeling member.

3 Claims, 4 Drawing Sheets

U.S. PATENT DOCUMENTS

| | | | | | |
|---|---|---|---|---|---|
| 6,006,014 | A | * | 12/1999 | Yamaguchi et al. | 358/1.18 |
| 6,019,529 | A | * | 2/2000 | Yamamoto et al. | 400/231 |
| 6,042,280 | A | * | 3/2000 | Yamaguchi et al. | 400/120.16 |
| 6,141,115 | A | * | 10/2000 | Naruse | 358/1.9 |
| 6,152,621 | A | * | 11/2000 | Langan | 400/120.02 |
| 6,309,118 | B1 | * | 10/2001 | Konno et al. | 400/237 |
| 7,014,376 | B2 | * | 3/2006 | Maruyama et al. | 400/120.01 |
| 7,217,047 | B2 | * | 5/2007 | Maruyama | 400/207 |
| 2001/0052923 | A1 | * | 12/2001 | Suzuki | 347/217 |

FOREIGN PATENT DOCUMENTS

| | | | |
|---|---|---|---|
| JP | 59-052668 | | 3/1984 |
| JP | 09-188048 | | 7/1997 |
| JP | 09202027 | * | 8/1997 |
| JP | 2002-144616 | | 5/2002 |
| JP | 2004-50598 | | 2/2004 |

OTHER PUBLICATIONS

European Search Report for Application No. EP 05 25 6791, dated Sep. 19, 2007.

* cited by examiner

THERMAL TRANSFER PRINTER

BACKGROUND OF THE INVENTION

1. Field of the Invention

The present invention relates to a thermal transfer printer, and more particularly, to a thermal transfer printer, which can reduce running costs of an ink ribbon.

2. Description of the Related Art

A thermal transfer printer 31 according to a related art will be described with reference to an invention disclosed in JP-A-2002-144616. As shown in FIG. 4, the thermal transfer printer 31 includes a printer main body 31*a*, a cassette mounting part 31*b* that can mount a ribbon cassette 39, to be described below, in the printer main body 31*a*.

In addition, a platen roller 32 is disposed in the printer main body 31*a*, and a thermal head 33 is disposed above the platen roller 32.

Further, a recording paper 34 is fed and conveyed between the thermal heat 33 and the platen roller 32.

The thermal head 33 is supported by a head support table 35, and the head support table 35 is mounted to a head lever 36. The head lever 36 is pivotally supported on the support shaft 37. As the head lever 36 pivots, the thermal head 33 can come in contact with and be separated from (head up/down) the platen roller 32.

In a head up state of the thermal head 33, as the ribbon cassette 39 to be described below is mounted in the cassette mounting part 31*b*, an ink ribbon 38 is positioned between the platen roller 32 and the thermal head 33.

The ink ribbon 38 is accommodated in the ribbon cassette 39 in a state in which both ends thereof are wound around a supply reel 39*a* and a take-up reel 39*b*.

As shown in FIG. 5, the ink ribbon 38 repeatedly forms ink surfaces 38*a*, 38*b* and 38*c* made of, for example, a yellow ink (Y), a cyan ink (C) and a magenta ink (M) and an overcoat layer 38*d* made of a transparent ink. These ink surfaces 38*a*, 38*b*, 38*c* and each of the overcoat layers 38*d* are formed in a size slightly larger than the printed area of the recording paper 34.

Two first markers 38*b* are formed in a transparent portion between the ink surfaces 38*a* of cyan and the ink surfaces 38*a* of yellow, and second markers 38*c* are respectively formed between the ink surfaces 38*a* of yellow and the ink surfaces 38*a* of magenta, and between the ink surfaces 38*a* of magenta and the ink surfaces 38*a* of cyan.

When detection of a ribbon detecting sensor 42 by the first markers 38*b* to be described below, a leading of the ink surface 38*a* of yellow is initially performed.

Further, a leading of the ink surface 38*a* of magenta and cyan is performed by the second marker 38*c*.

A transparent space part 38*d* with a dimension B is formed from the first and second markers 38*b* and 38*c* to the ink surfaces 38*a* of the respective colors.

A relief groove 39*d* is formed on the left side (in the drawing) of a partition wail 39*e* in the ribbon cassette 39, and a take-up opening 39*f* is formed on the bottom of the relief groove 39*d* (in an upper portion of the drawing). At a side plate 39*c* around the take-up opening 39*f* a guide roller 39 g made of a metal rod is rotatably supported.

During printing, the ink ribbon 38, which is closely in contact with the recording paper 34, is separated from the thermal head 33 at a predetermined separation angle, then passes by a guide roller 39*g* and is wound around the take-up reel 39*b*.

A paper feed roller 40 and a pressure-contact roller 41 which is pressure-contacted to the paper feed roller 40 are disposed on the left side of the platen roller 32 in the drawing. While being pinched between the paper feed roller 40 and the pressure-contact roller 41, the recording paper 34 is conveyed in a direction indicated by an arrow A.

When the ribbon cassette 39 is mounted in the cassette mounting part 31*b*, the pressure-contact roller 41 is located in the relief groove 39*d*.

In a portion where the relief groove 39*d* is located, an optical ribbon detecting sensor 42 is disposed. A reflective part (not shown) having glossiness which reflects a light irradiated from the ribbon detecting sensor 42 is formed in a partition wall 39*e* which faces the ribbon detecting sensor 42. A dimension from a heating element of the thermal head 33 in a head down state to the ribbon detecting sensor 42 is equal to a dimension B of the space part 38*d* of the ink ribbon 38.

A printing operation of the thermal transfer printer 31 according to the related art will be described. In the head up state of the thermal head 33, the ink ribbon 38 is wound by rotatingly driving the take-up reel 39*b*, and then when the ribbon detecting sensor 42 detects the first marker 38*b*, the winding of the ribbon stops. Then, a front end of the initial ink surface 38*a* of yellow of the ink ribbon 38 is arranged in a portion where the heating element of the thermal head 33 is formed, whereby a leading of the ink ribbon is performed.

While a front end 34*a* of the fed recording paper 34 is pinched between the paper feed roller 40 and the pressure-contact roller 41, a leading of the recording paper 34 is performed. Afterwards, after changing the state of the thermal head 33 to the head down state, the recording paper 34 is conveyed in the direction indicated by the arrow A by rotating the paper feed roller 40. At the same time, by selectively heating the heating element of the thermal head 33, an initial ink of yellow is thermally transferred so that an image of yellow is printed on the recording paper 34.

Then, after changing the state of the thermal head 33 to the head up state, the recording paper 34 is fed backward, and then a paper cue is performed and the ribbon detecting sensor 42 detects the second markers 38*c* of the ink surface 38*a* of magenta with the take-up reel 39*b*, so that a leading of the ink surface 38*a* of magenta is performed.

Then, after changing the state of the thermal head 33 to the head down state, an image of magenta is overlaid on the image of yellow. Afterwards, by repeating the above operation, an image of cyan is overlaid on the image of magenta so as to be printed, whereby it is possible to print an image of a desired color on the recording paper 34.

However, in the thermal transfer printer 31 according to the related art, since the ribbon detecting sensor 42 is disposed in the relief groove 39*d* of the ribbon cassette 39 which is estranged from the heating element of the thermal head 33, the dimension B of the space part 38*d* of the ink ribbon 38 corresponding to the dimension from the heating element of the thermal head 33 to the ribbon detecting sensor 42 is made long.

For this reason, portions of the ink ribbon 38 which do not contribute to printing increase, thus increasing running cost. Therefore, printing cost for one recording paper 34 becomes high.

SUMMARY OF THE INVENTION

The invention has been made to solve the above-mentioned problems, and it is an object of an aspect of the invention to provide a thermal transfer printer which can reduce the running cost of an ink ribbon so as to decrease printing cost for one recording paper.

In order to solve the above-mentioned problem, according to a first aspect of the invention, a thermal transfer printer includes a thermal head, a platen roller, a head up/down mechanism which brings the thermal head into contact with the platen roller and separates the thermal head from the platen roller, an ink ribbon which is drawn between the thermal head and the platen roller, a paper feed roller which can convey the recording paper, a peeling member which is disposed on the downstream side of the thermal head in a conveyance direction of the recording paper and can peel the ink ribbon adhered onto the recording paper during printing, and an optical ribbon detecting sensor which is disposed between the thermal head and the peeling member and can detect a color discernment marker corresponding to an ink surface of a desired color formed on the surface of the ink ribbon.

Furthermore, according to a second aspect of the invention, in the thermal transfer printer, it is preferable that a reflective plate which can reflect light irradiated from the ribbon detecting sensor be disposed in a drawing path of the ink ribbon which faces the ribbon detecting sensor.

Further, according to a third aspect of the invention, in the thermal transfer printer, it is preferable that the peeling member be rotatably supported by a head guide which can come in contact with and be separated from the platen roller in conjunction with the head up/down operation of the thermal head.

Moreover, according to a fourth aspect of the invention, in the thermal transfer printer, it is preferable that the paper feed roller be disposed downstream of the platen roller in the conveyance direction of the recording paper, the reflective plate be disposed between the platen roller and the paper feed roller, and the ribbon detecting sensor be disposed in the head guide which faces the reflective plate.

In addition, according to a fifth aspect of the invention, in the thermal transfer painter, it is preferable that a paper guide, which can guide the recording paper to be conveyed, be disposed in a conveyance path of the recording paper formed between the platen roller and the paper feed roller, and the reflective plate be mounted on the surface of the paper guide.

DESCRIPTION OF THE PREFERRED EMBODIMENT

Figure 1:
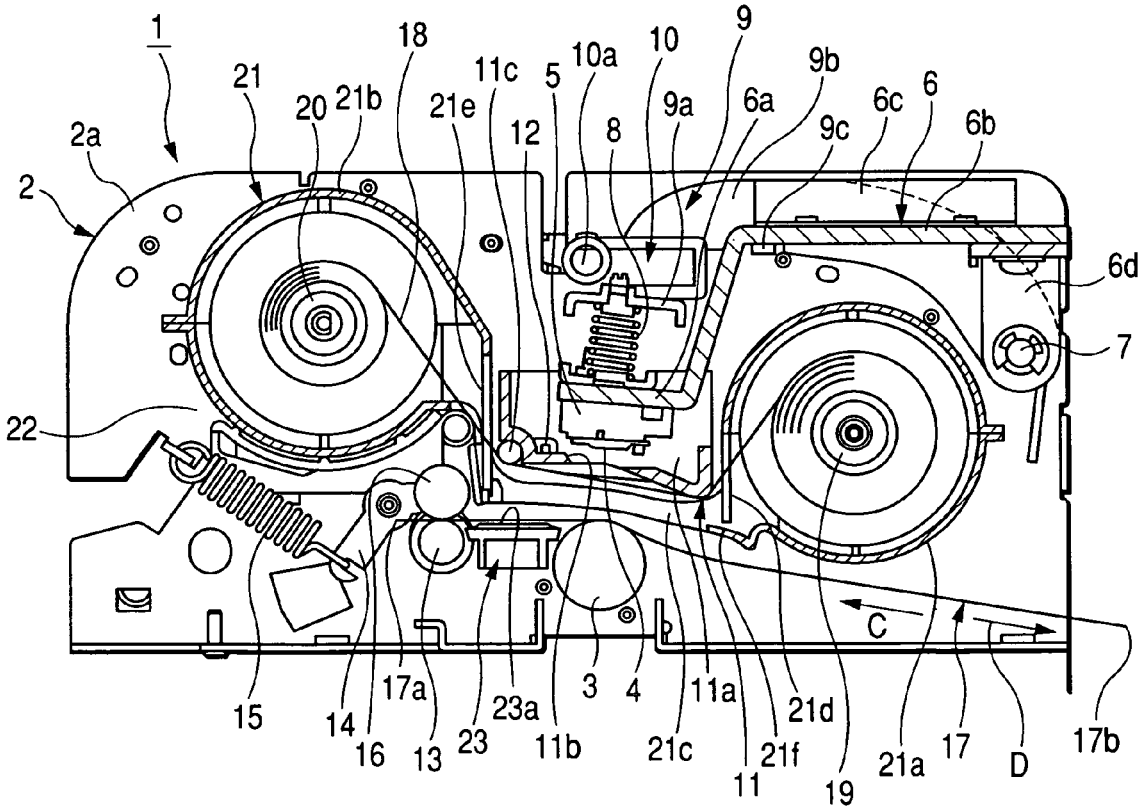
FIG. 1 is a cross-sectional view showing essential parts of a thermal transfer printer according to the invention.
Figure 2:
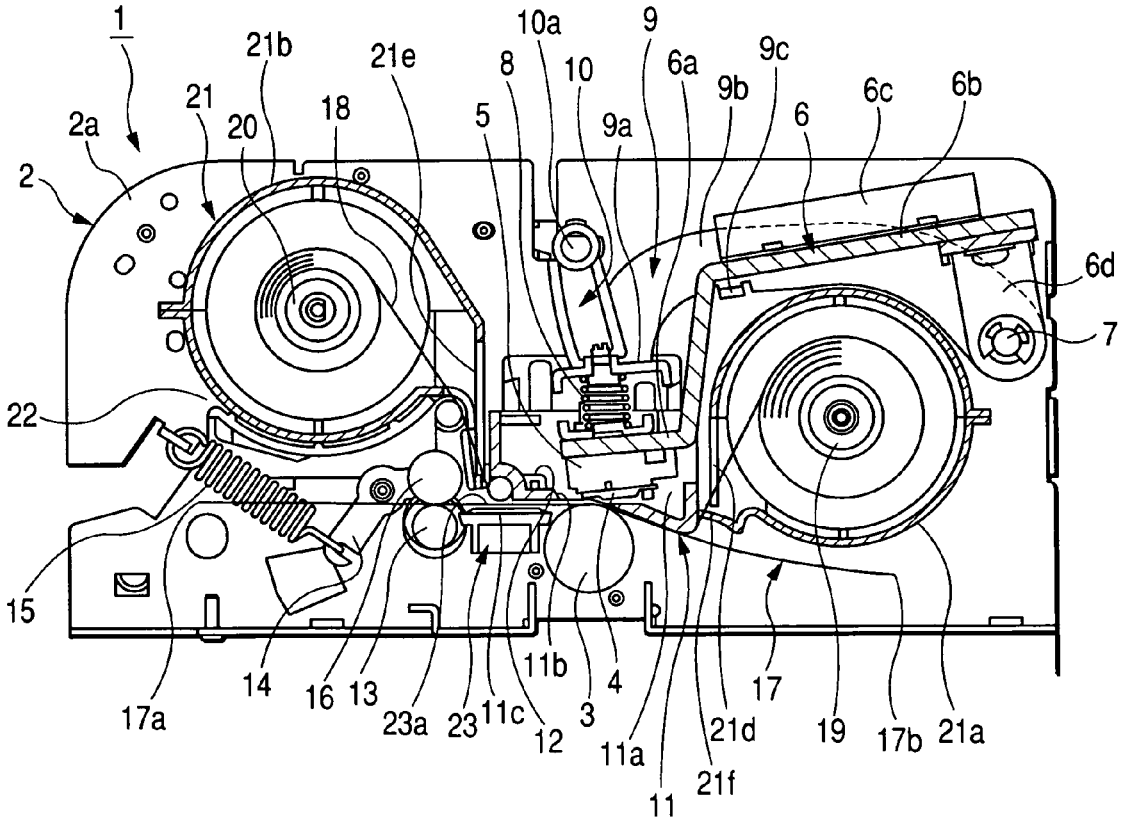
FIG. 2 is a cross-sectional view showing essential parts of the thermal transfer printer according to the invention.
Figure 3:
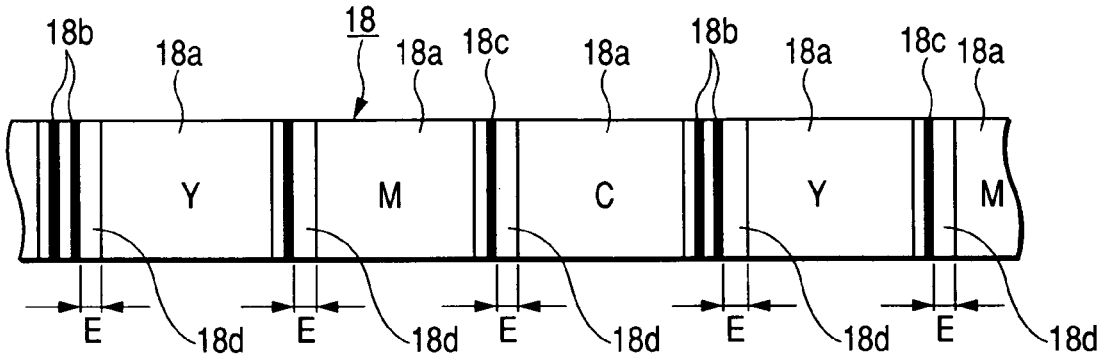
FIG. 3 is a plan view showing an ink ribbon according to the invention.
Figure 4:
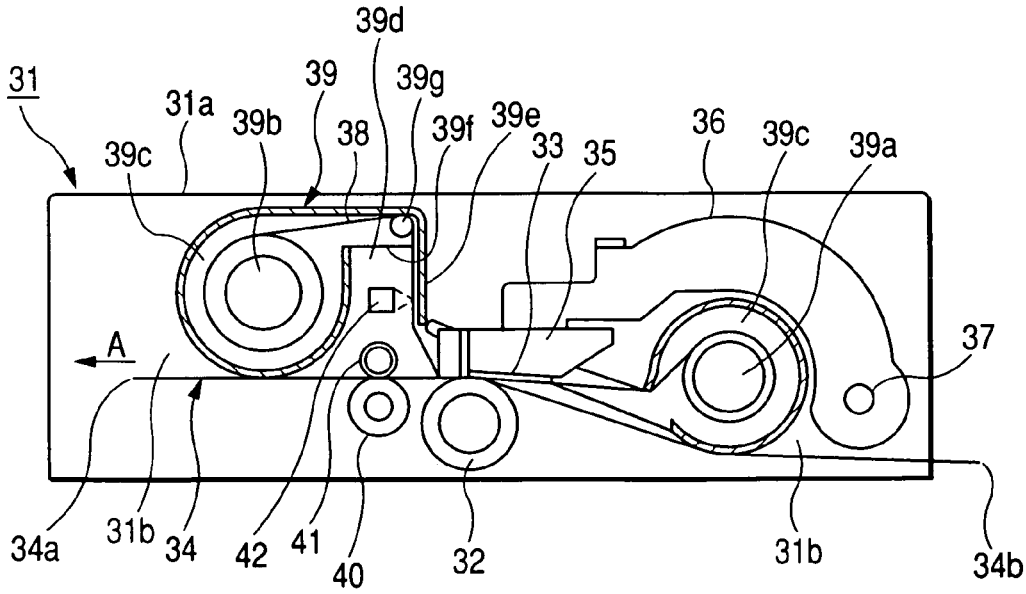
FIG. 4 PRIOR ART
FIG. 4 is a cross-sectional view showing essential parts of a thermal transfer printer according to the related art.
Figure 5:
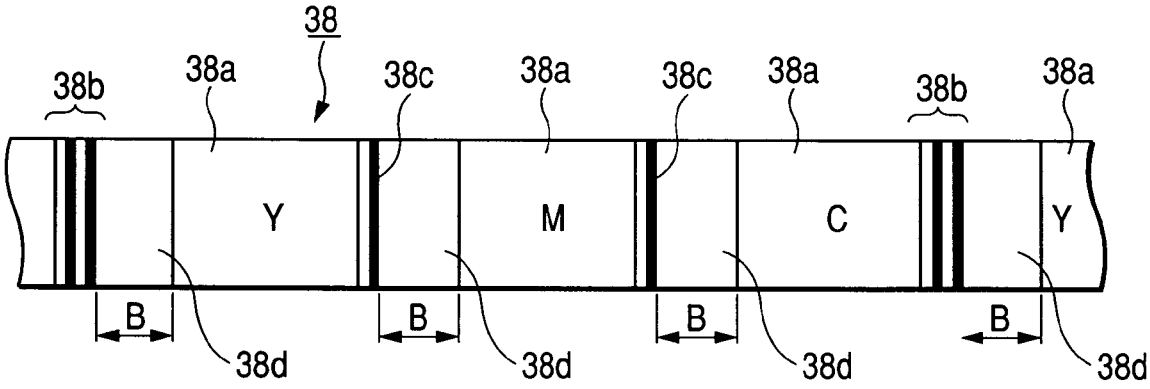
FIG. 5 PRIOR ART
FIG. 5 is a plan view showing an ink ribbon according to the related art.

Hereinafter, a thermal transfer printer according to an embodiment of the invention will be described with reference to FIGS. 1 to 3. FIGS. 1 and 2 are cross-sectional views showing essential parts of a thermal transfer printer according to the invention, and FIG. 3 is a plan view showing an ink ribbon according to the invention.

As shown in FIG. 1, a cylindrical platen roller 3, which is rotatably supported by a side plate 2*a* of a main body case 2, is disposed in a lower portion of a thermal transfer printer 1.

A thermal head 4 composed of a long line head, which is parallel to an axis of the platen roller 3, is disposed in an upper portion which faces the platen roller 3.

The thermal head 4 includes a plurality of the heating elements (not shown) that is arranged on the side facing the platen roller 3 in a longitudinal direction thereof, and is mounted to a head supporting member 6 by a head mounting table 5.

The head supporting member 6 includes a head supporting part 6*a* to which the head mounting table 5 is mounted and an extension part 6*b* which extends in the right direction (in the drawing) from the head supporting part 6*a* in a crank shape. A heat sink part 6*c*, which can radiate the heat of the thermal head 4, is mounted to the extension part 6*b*.

Furthermore, at a right end of the extension part 6*b* in the drawing, a supporting arm 6*d* is mounted downward, and the supporting arm 6*d* is rotatably supported to a support shaft 7 which is bridged and supported by a side plate of the main body case 2.

As the head supporting member 6 rotates about the support shaft 7 as a fulcrum, the thermal head 4 can come in contact with and be separated from (head up/down) the platen roller 3.

A lower end of a first coil spring 8 is supported by the head supporting part 6*a* of the head supporting member 6. Furthermore, an upper end of the first coil spring 8 is elastically urged by a pressure-contact plate 9*a* of a pressure-contact member 9. The pressure-contact member 9 includes the long pressure-contact plate 9*a* which is parallel to a longitudinal direction of the thermal head 4 on one end thereof, and both ends of the pressure-contact plate 9*a* are integrally formed on one end of a pair of rotating arms 9*b*.

In addition, the other ends of the rotating arms 9*b* are supported by the support shaft 7, and the pressure-contact plate 9*a* moves up and down as the rotating arms 9*b* rotate about the support shaft 7 as a fulcrum.

In the pressure-contact member 9, a holding part 9*c* is formed by cutting and bending a portion of each of the rotating arms 9*b*, and the extension part 6*b* of the head supporting member 6 is held by the holding part 9*c*. Further, the pressure-contact member 9 is elastically urged upward by an elastic member (not shown). Therefore, when the pressure-contact plate 9*a* is released from pressure-contact that is caused by a cam member 10 to be described below, the head supporting member 6 and the pressure-contact member 9 rotates upward about the support shaft 7 as a fulcrum so that the stated of the thermal head 4 changes to the head up state. Furthermore, the pressure-contact member 9 can move up and down as the pressure-contact plate 9*a* is pressed against the cam member 10, which is rotatably supported by a support shaft 10*a* supported on the side plate 2*a*.

A head guide 11 is disposed separately from the head supporting member 6 so as to surround the head mounting table 5 to which the thermal head 4 is mounted. The head guide 11 has a hollow part 11*a* formed therein, and a lower portion of the hollow part 11*a* is opened by an opening 11*b*.

In addition, a peeling roller 11*c* is rotatably supported at a lower left end of the head guide 11 in the drawing so as to strip an ink ribbon 18 adhered to a recording paper 17, to be described below, during printing.

An optical ribbon detecting sensor 12 is disposed on the left side of the opening 11*b* (on the downstream of the thermal head 4 in a paper feed direction of the arrow A of the recording paper 17 to be described below) inside the hollow part 11*a* of the head guide 11. The ribbon detecting sensor 12 detects an ink surface of the ink ribbon 18 to be described below so that it is possible to perform a ribbon head leading which allows the ink surface to be positioned in an initial printing position.

The head guide 11 is elastically urged upward at all times, that is, above the platen roller 3 by the elastic member (not shown). In the head up state of the thermal head 4, that is, a printing standby state, as shown in FIG. 1, the head guide 11 ascends from the platen roller 3 by a predetermined height.

The head guide 11 independently moves up and down by the same driving source which drives the cam member 10.

At the time when the thermal head 4 moves down to print, the head guide 11 moves down to the vicinity of the platen roller, and then the plurality of heating elements of the thermal head 4 is positioned at the opening 11*b* so as to be pressure-contacted to the platen roller 3.

In addition, a paper feed roller 13 and a pressure-contact roller 16 which is pressure-contacted to the paper feed roller 13 by an urging force of a second coil spring 15 via a lever 14 are disposed on the right side of the platen roller 3 in the drawing.

Between the thermal head 4 in the head up state and the platen roller 3, the recording paper 17 made of a thick paper such as a printing paper on which color printing can be performed is fed in a direction indicated by an arrow C by a paper feed roller (not shown) so as to be pinched between the paper feed roller 13 and the pressure-contact roller 16.

The recording paper 17 which is pinched between the paper feed roller 13 and the pressure-contact roller 16 can be conveyed in the direction indicated by the arrow C and in the opposite direction indicated by an arrow D by the rotation of the paper feed roller 13.

The recording paper 17 is fed between the platen roller 3 and the thermal head 4 and conveyed in the direction indicated by the arrow C. When a front end 17*a* of the recording paper 17 which is pinched between the paper feed roller 13 and the pressure-contact roller 16 is detected by a paper sensor (not shown) and then a ribbon head leading is performed, the rotation of the paper feed roller 13 temporarily stops.

In addition, between the thermal head 4 in the head up state and the platen roller 3, the ink ribbon 18 is pulled above the recording paper 17.

The ink ribbon 18 has a width slightly larger than the width of the recording paper 17. As shown in FIG. 3, an ink surface 18*a*, which is coated with, for example, ink of yellow (Y), cyan (C) and magenta (M) is formed on one side of the ink ribbon 18, that is, on the bottom side (which faces the recording paper 17) thereof, and is formed slightly longer than a printed area of the recording paper 17.

First markers 18*b* composed of two black lines are formed on transparent portions between the ink surfaces 18*a* of cyan and the ink surfaces 18*a* of yellow, respectively. Second markers 18*c* composed of one black line are formed between the ink surfaces 18*a* of yellow and the ink surfaces 18*a* of magenta, and between the ink surfaces 18*a* of magenta and the ink surfaces 18*a* of cyan, respectively.

As the ribbon detecting sensor 12 detects the first markers 18*b*, a leading of the ink surface 18*a* of an initial yellow is performed. Further, as the ribbon detecting sensor 12 detects the second markers 18*c*, a leading of the ink surface 18*a* of magenta and cyan is performed.

A transparent space part 18*d* with a dimension E is formed between the first and second markers 18*b* and 18*c* and the ink surfaces 18*a* of the respective colors.

The dimension E of the space part is slightly smaller than a dimension from the heating element of the thermal head 4 to the ribbon detecting sensor 12.

Both ends of the ink ribbon 18 are wound around a supply reel 19 and a take-up reel 20 so as to be accommodated in the ribbon cassette 21.

As shown in FIG. 1, the ribbon cassette 21 is provided with a first ribbon accommodating part 21*a* which accommodates the supply reel 19 having an unused ink ribbon 18 wound therearound and a second ribbon accommodating part 21*b* which accommodates the take-up reel 20 capable of winding a used ink ribbon 18.

The first and second ribbon accommodating parts 21*a* and 21*b* are connected to each other by a connection wall 21*c*, which is formed to face each other.

In the ribbon cassette 21, a drawing aperture 21*d* through which the ink ribbon 18 wound around the supply reel 19 can be drawn is formed on the connection wall 21*c* side of the first ribbon accommodating part 21*a*, and a take-up aperture 21*e* is formed on the connection wall 21*c* side of the second ribbon accommodating part 21*b* so that the ink ribbon 18 drawn from the drawing aperture 21*d* can be wound around the take-up reel 20.

An insertion aperture 21*f* in which the head guide 11 moving vertically can be inserted is formed in the connection wall 21*c* of the ribbon cassette 21.

The ribbon cassette 21 can be mounted in the cassette mounting part 22 formed in the main body case 2 while the thermal head 4 is in the head up state and the head guide 11 is raised.

A paper guide 23, which can guide the recording paper 17 to be conveyed so as to prevent the recording paper 17 from being bent downward, is disposed in a conveyance path of the recording paper 17 between the platen roller 3 and the paper feed roller 13. For example, a reflective plate 23*a*, which is mirror-finished so as to have glossiness on the surface thereof, is fixed to the paper guide 23 with adhesives.

Alternatively, the paper guide 23 may be also composed of a reflective plate which has a glossy reflective surface directly formed on the surface thereof with the means of metal plating.

An operation of the thermal transfer printer 1 having the above construction according to the invention will be described. In an initial state, that is, a printing standby state, the thermal head 4 is in the head up state and the head guide 11 ascends so as to be separated from the platen roller 3. In the initial state, that is, in the printing standby state, the ink ribbon 18 is wound by rotating the take-up reel 20, and then the ribbon detecting sensor 12 detects the first markers 18*b* so as to perform a ribbon head leading of the ink surface 18*a* of an initial yellow.

Afterwards, the recording paper 17 is fed in the direction indicated by the arrow C from the right side in the drawing between the thermal head 4 and the head guide 11 in the initial state and the platen roller 3, and then the front end 17*a* of the recording paper 17 is pinched between the paper feed roller 13 and the pressure-contact roller 16, thereby performing a leading of the recording paper 17.

When a leading of the recording paper 17 and the ink ribbon 18 is performed, the pressure-contact plate 9*a* of the pressure-contact member 9 is pressed down by rotating the cam member 10. Then, the head supporting plate 6 rotates downward by the first coil spring 8 so that the thermal head 4 begins to move down.

At the same time, the head guide 11 individually descends, and the bottom surface of the head guide 11 presses the recording paper 17 so as to be reliably in a close contact with an outer peripheral surface of the platen roller 3 before the thermal head 4 is pressure-contacted to the platen roller 3.

For this reason, even though the recording paper 17 is twisted, the twisted recording paper 17 can be reliably pressed against the platen roller 3 by the head guide 11.

After the head guide 11 descends, the thermal head 4 in the head down state presses the ink ribbon 8 and the recording paper 17 against the platen roller 3.

As the plurality of heating elements of the thermal head 4 is selectively heated on the basis of print information and the recording paper 17 is conveyed in the direction indicated by the arrow C, ink of the ink surface 18*a* of an initial yellow of the ink ribbon 18 is transferred onto the recording paper 17 so as to print an image of yellow.

Then, the thermal head 4 is in the head up state and the head guide 11 is raised, and the recording paper 17 is fed backward in the direction indicated by the arrow D.

Then, a leading of the recording paper 17 is repeatedly performed, and the thermal head 4 is in the head down state so that ink of the ink surface 18*a* of magenta is printed on the image of yellow, whereby an image of magenta is overlaid on the image of yellow so as to be printed.

As the printing operation is performed several times, an image of a desired color can be printed on the recording paper 17.

In the thermal transfer printer 1 according to the invention, since the ribbon detecting sensor 12 is disposed around the downstream of the thermal head 4, the dimension E of the space part 18*d* of the ink ribbon 18 can be made small, thus reducing running cost of the ink ribbon 18. For this reason, image printing cost for one recording paper 17 can be decreased.

In the preferred embodiment of the invention, the ribbon detecting sensor 12 is mounted to the head guide 11. However, the ribbon detecting sensor 12 may be mounted to the head mounting table 5 or the head supporting member 6.

In addition, in the invention, even though the head guide 11 is provided, the head guide 11 may be excluded. At this time, the peeling roller 11*c* may be supported by the side plate 2*a* of the main body case 2.

In the thermal transfer printer according to the invention, the peeling member capable of peeling the ink ribbon which is adhered onto the recording paper during printing is disposed on the downstream side of the thermal head in the conveyance direction of the recording paper. Further, the optical ribbon detecting sensor capable of detecting a discernment marker corresponding to an ink surface of a desired color formed on the surface of the ink ribbon is disposed between the thermal head and a peeling roller. Thus, a distance from the thermal head to the ribbon sensor can be made small.

For this reason, a dimension of a space portion from a discernment marker of the ink ribbon to the ink surface, corresponding to the distance from the thermal head to the ribbon sensor, can be made small. Accordingly, running cost of the ink ribbon can be reduced, and image printing cost for one recording paper can be decreased.

In addition, since the reflective plate which can reflect light irradiated from the ribbon detecting sensor is disposed in the drawing path of the ink ribbon which faces the ribbon detecting sensor, a marker formed on the ink ribbon can be reliably detected by reflecting the light output from the ribbon sensor with the reflective plate.

Further, since the head guide which can come in contact with and be separated from the platen roller in conjunction with the head up/down operation of the thermal head is disposed, and the peeling roller is rotatably supported by the head guide, the peeling roller moves up and down as the head guide moves up and down. Thus, the ribbon cassette can be easily mounted in the cassette mounting part, which leads to improved workability.

The paper feed roller is disposed downstream of the platen roller in the conveyance direction of the recording paper, the reflective plate is disposed between the platen roller and the paper feed roller, and the ribbon detecting sensor is disposed in the head guide which faces the reflective plate. Therefore, the distance from the thermal head to the ribbon sensor can be made small.

The guide member which can guide the recording paper which is being conveyed is disposed in the conveyance path of the recording paper formed between the platen roller and the paper feed roller, and the reflective plate is mounted on the surface of the guide member whereby it is possible to reduce the number of constituent parts.

The invention claimed is:

1. A thermal transfer printer comprising:

a thermal head;

a platen roller;

a head up/down mechanism which brings the thermal head into contact with the platen roller and separates the thermal head from the platen roller;

a head guide which can come in contact with and be separated from the platen roller independently of the thermal head;

an ink ribbon which is drawn between the thermal head and the platen roller and which is received in a ribbon cassette with both ends wound on a feed reel and a take-up reel, respectively;

a paper feed roller which is disposed downstream of the platen roller in a conveyance direction of a recording paper and can convey the recording paper;

a peeling member which is rotatably supported by the head guide between the paper feed roller and the platen roller and can peel the ink ribbon adhered onto the recording paper during printing;

an optical ribbon detecting sensor which is disposed in the head guide between the thermal head and the peeling member, and can detect a color discernment marker corresponding to an ink surface of a desired color formed on the surface of the ink ribbon; and a reflective plate which can reflect light irradiated from the ribbon detecting sensor, the reflective plate being disposed in a drawing path of the ink ribbon which faces the ribbon detecting sensor.

2. The thermal transfer printer according to claim 1, wherein a paper guide, which can guide the recording paper to be conveyed, is disposed in a conveyance path of the recording paper formed between the platen roller and the paper feed roller, and the reflective plate is mounted on the surface of the paper guide.

3. The thermal transfer printer according to claim 1, wherein the peeling roller and the optical ribbon detecting sensor are mounted in a head guide that follows the movement of the head up/down mechanism.

* * * * *